US005454835A

United States Patent [19]

Wu

[11] Patent Number: 5,454,835

[45] Date of Patent: Oct. 3, 1995

[54] PACIFIER WITH A CUP-SHAPED SHIELD

[76] Inventor: Teng-Shan Wu, P.O. Box 82-144, Taipei, Taiwan

[21] Appl. No.: 357,737

[22] Filed: Dec. 16, 1994

[51] Int. Cl.[6] ..... A61J 17/00

[52] U.S. Cl. ..... 606/235; 606/236

[58] Field of Search ..... D24/194–199; 606/234–236; 604/76–78; 374/151

[56] References Cited

U.S. PATENT DOCUMENTS

| | | | |
|---|---|---|---|
| 3,825,014 | 7/1974 | Wroten | 606/236 |
| 4,896,666 | 1/1990 | Hinkle | 606/235 |
| 5,078,734 | 1/1992 | Noble | 606/236 |

*Primary Examiner*—Stephen C. Pellegrino
*Assistant Examiner*—Glenn Dawson
*Attorney, Agent, or Firm*—Alfred Lei

[57] ABSTRACT

A pacifier including a generally cup-shaped member which is open at one end and is formed with a plurality of ribs and thin film portions, each of the ribs alternating with one of the thin film portions around an outer surface of the cup-shaped member. The cup-shaped member is formed with a plurality of ventilation holes thereon. A hollow nipple is integrally formed with the cup-shaped member and has an enlarged head and extends outwardly from a center of the cup-shaped member. A handle is integrally formed with another end of the cup-shaped member.

2 Claims, 7 Drawing Sheets

PACIFIER WITH A CUP-SHAPED SHIELD

BACKGROUND OF THE INVENTION

The conventional pacifier (see FIG. 1) is simply a teething means which includes a nipple A and a lip guard B. In order to provide a soft feeling, the pacifier is now made of silicone rubber. However, as the lip guard B is a rigid member, the infant must use more effort to hold the nipple thereby easily making his tongue feel tired and probably decreasing his appetite thereafter.

SUMMARY OF THE INVENTION

This invention relates to an improved pacifier.

It is the primary object of the present invention to provide a pacifier which can make the baby have the same feeling as the mother's teat.

It is another object of the present invention to provide a pacifier which is of good resiliency.

It is still another object of the present invention to provide a pacifier which is of good ventilation.

It is still another object of the present invention to provide a pacifier which can be also used as a biting practice means.

It is a further object of the present invention to provide a pacifier which is practical in use.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
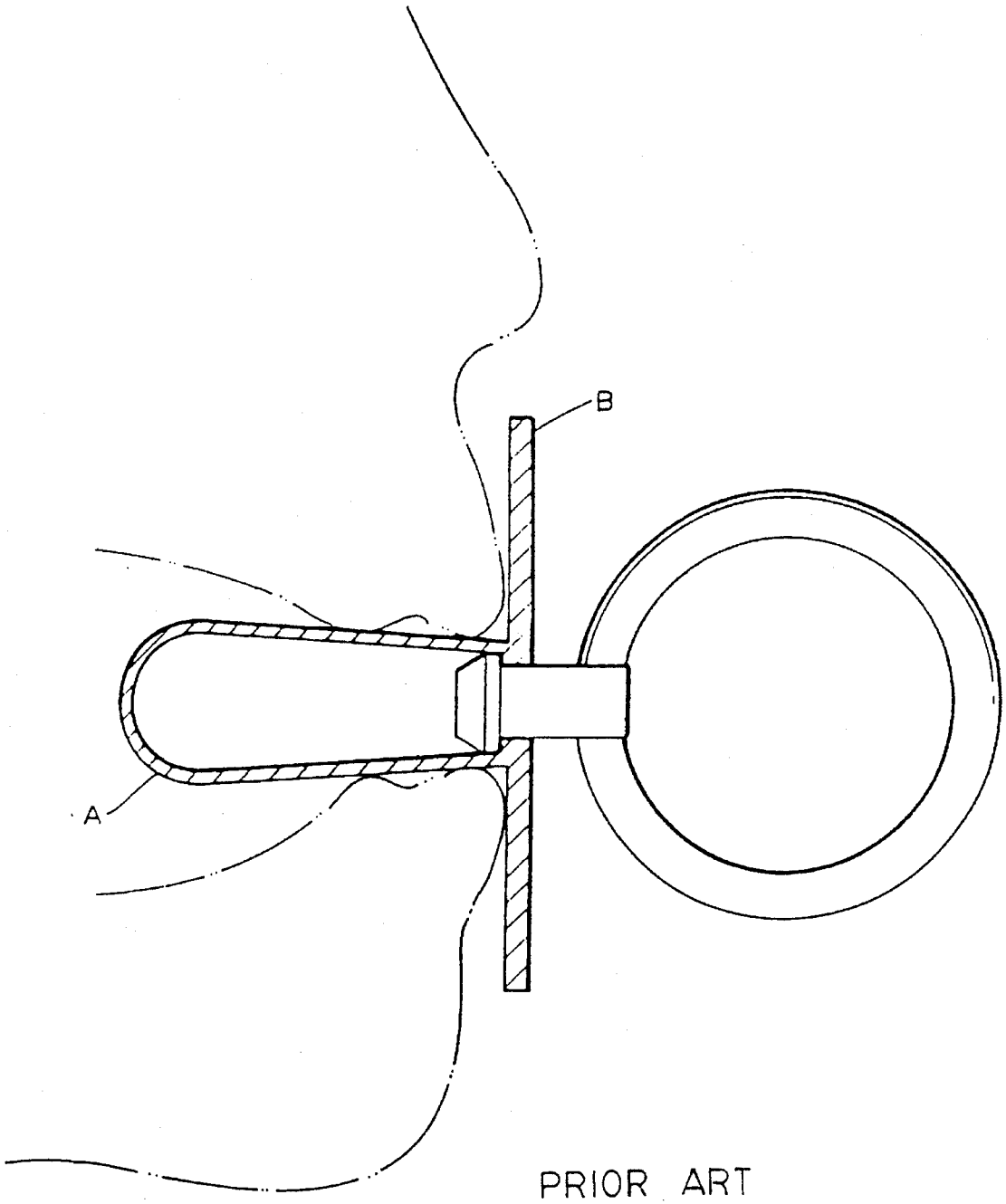
PRIOR ART FIG. 1
FIG. 1 is a sectional view of a prior art pacifier.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
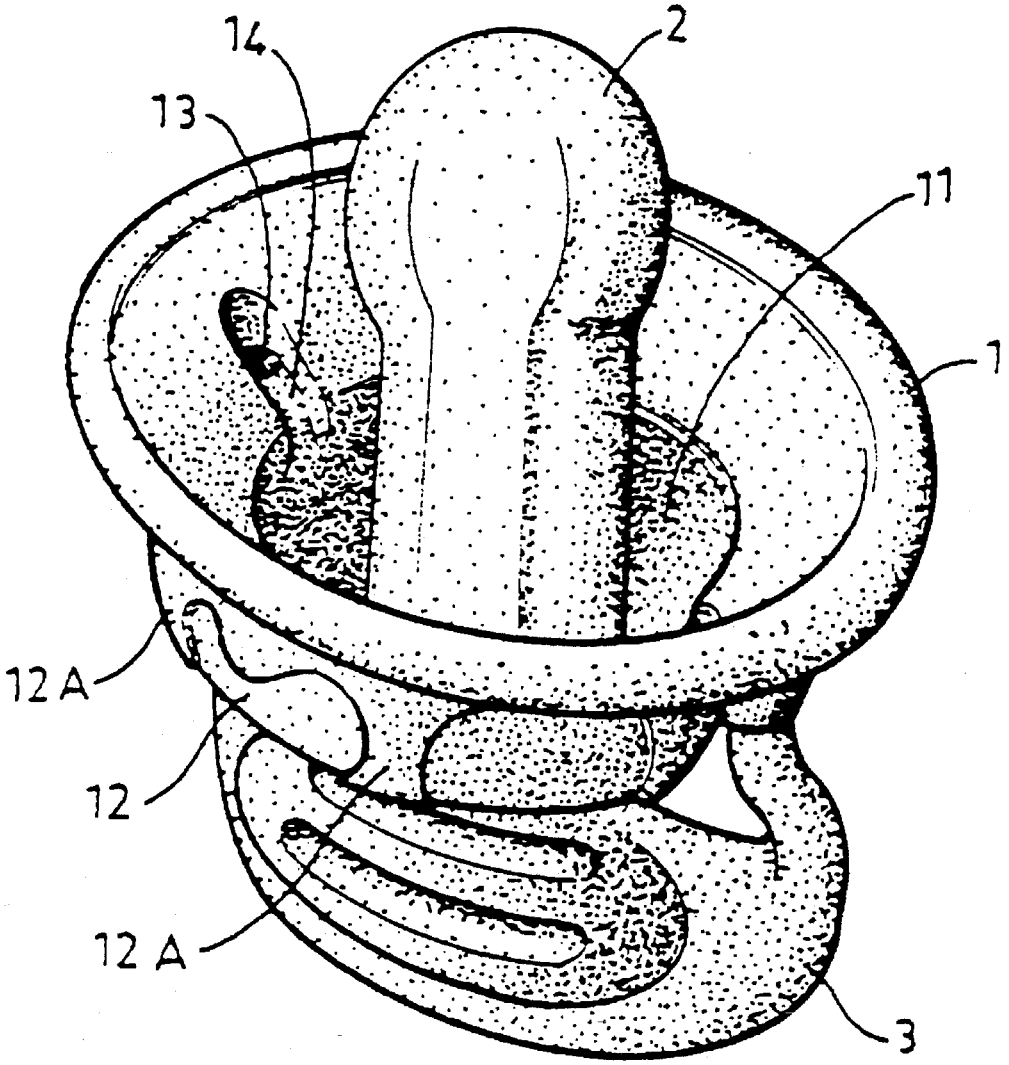
FIG. 2 is a perspective view of the present invention.

With reference to the drawings and in particular to FIG. 2 thereof, the pacifier according to the present invention mainly comprises a cup-shaped member 1, a nipple 2 and a handle 3.

Figure 3:
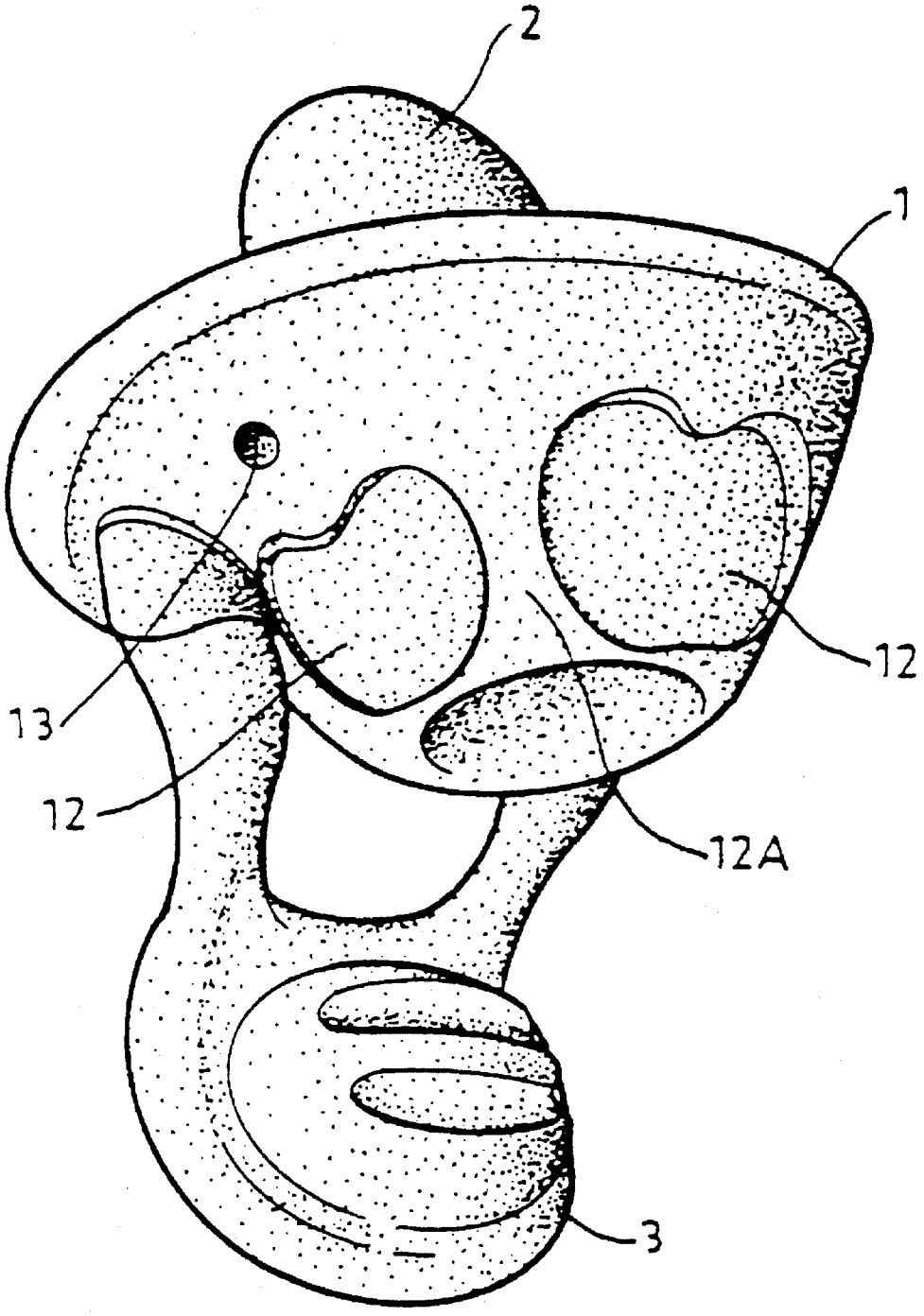
FIG. 3 is another perspective view of the present invention.
Figure 4:
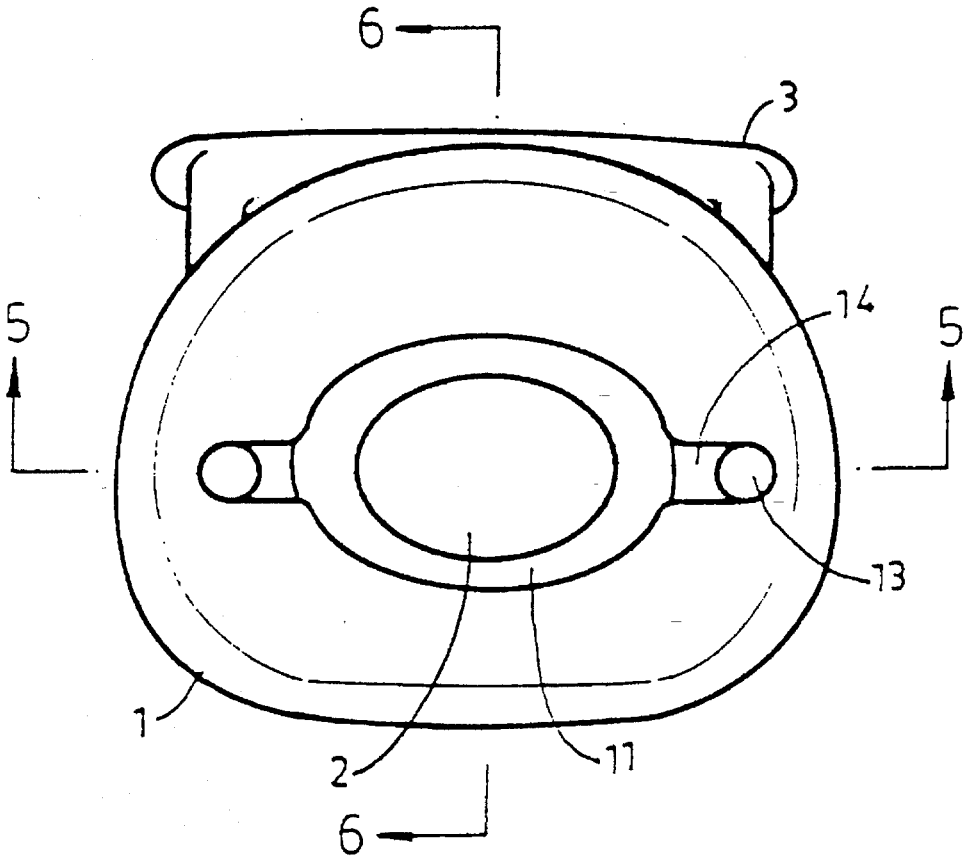
FIG. 4 is a top view of the present invention.
Figure 5A:
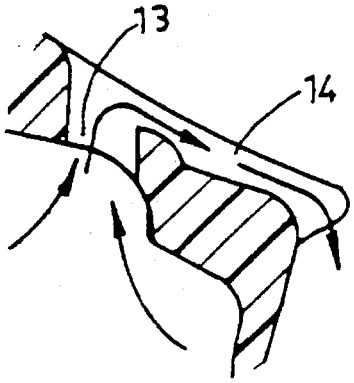
FIG. 5A is an enlarged fragmentary view of the present invention.
Figure 5:
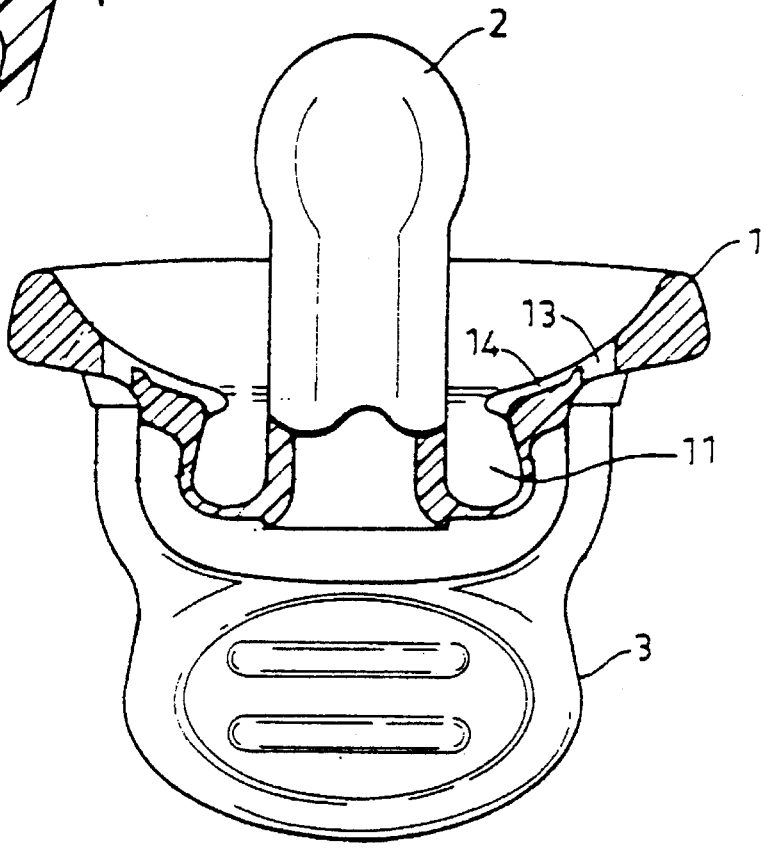
FIG. 5 is a sectional view taken along line 5—5 of FIG. 4.

As illustrated in FIGS. 2 and 3, the cup-shaped member 1 is formed with a plurality of ribs 12A. There is a thin film portion 12 which alternates with the rib 12A around the outer surface of the cup-shaped member 1. Further, the upper portion of the inner surface of the cup-shaped member 1 is formed with two recesses 14 communicating with the inner bottom 11 of the cup-shaped member 1. The recess 14 is formed with a ventilation hole 13 (see FIGS. 4, 5 and 5A).

The nipple 2 is a hollow member which is integral with cup-shaped member 1 and extends outwardly from the center thereof. In addition, the nipple 2 is formed with an enlarged head portion.

Figure 6:
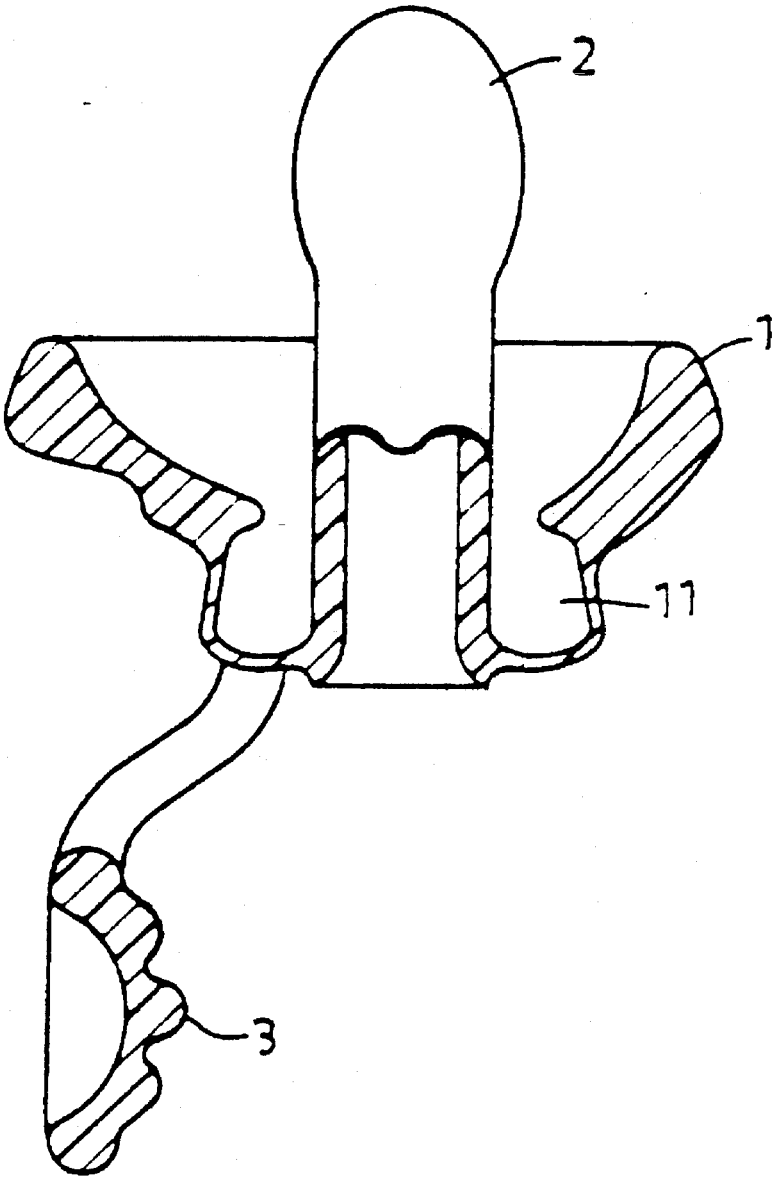
FIG. 6 is a sectional view taken along line 6—6 of FIG. 4.

The handle 3 is integral with the other side of the cup-shaped member 1 and provides biting practice means (see FIG. 6).

Figure 7:
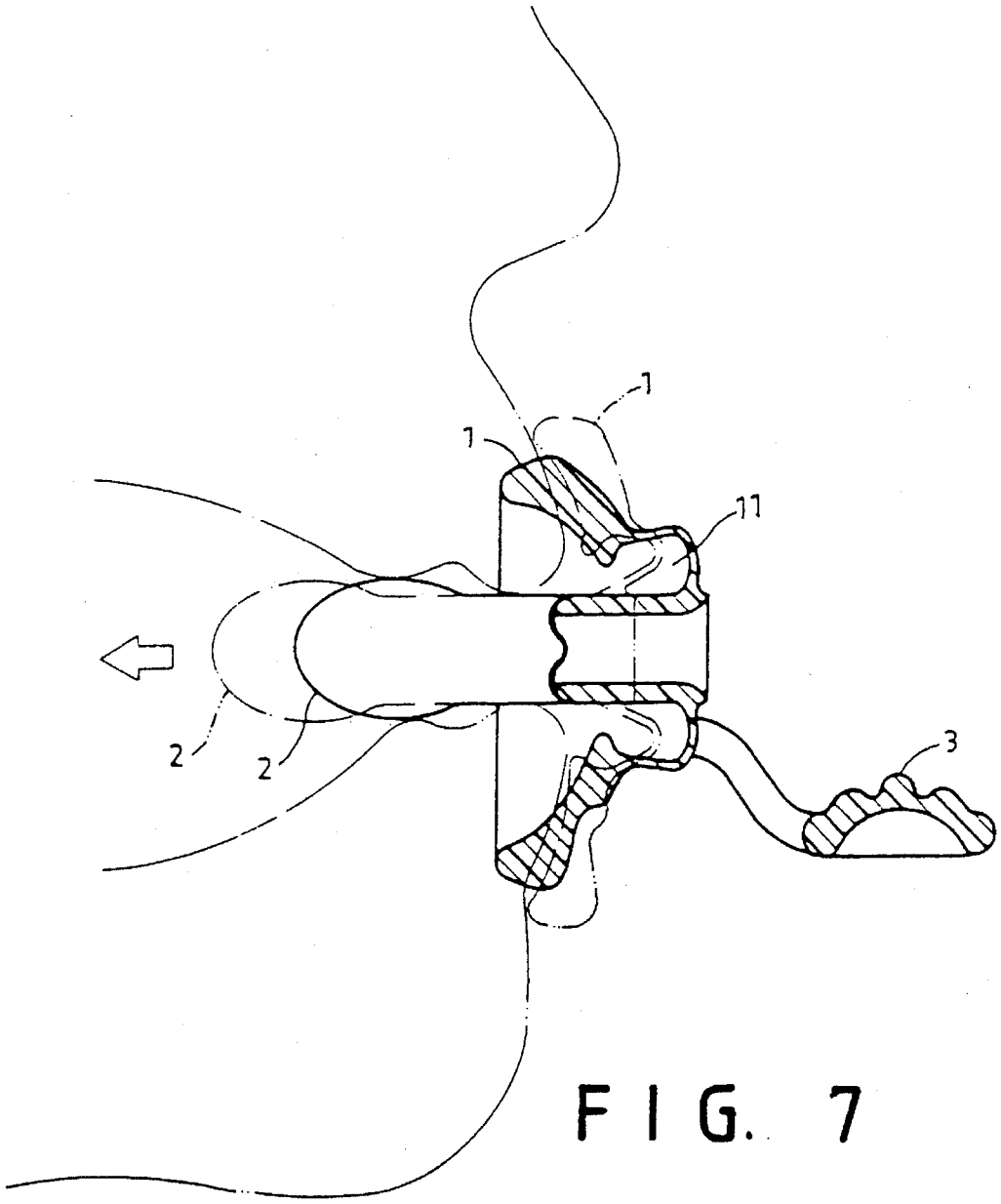
FIG. 7 is a working view of the present invention.

When in use, the thin film portions 12 of the cup-shaped member 12 provide this invention with the ability to adapt to the infant's mouth (see FIG. 7). With the present invention, the cup-shaped member 1 replaces the lip guard B of the conventional pacifier thereby allowing the infant to effortlessly hold the nipple and therefore reducing feeling of tiredness to the tongue and lack of appetite. The ventilation holes 13 are designed to reduce the suction within the cup-shaped member 1 hence preventing the cup-shaped member 1 from sticking to the infant's mouth.

The invention is naturally not limited in any sense to the particular features specified in the forgoing or to the details of the particular embodiment which has been chosen in order to illustrate the invention, Consideration can be given to all kinds of variants of .the particular embodiment which has been described by way of example and of its constituent elements without thereby departing from the scope of the invention, This invention accordingly includes all the means constituting technical equivalents of the means described as well as their combinations,

I claim:

1. A pacifier comprising:

a generally cup-shaped member which is open at one end and is formed with a plurality of ribs and thin film portions, each of said ribs alternating with one of said thin film portions around an outer surface of said cup-shaped member, said cup-shaped member being formed with a plurality of ventilation holes thereon;

a hollow nipple integral with the cup-shaped member and having an enlarged head and extending outwardly from a center of the cup-shaped member; and a handle integrally formed with another end of said cup-shaped member.

2. The pacifier as claimed in claim 1, wherein said handle is formed with biting practice means.

* * * * *